US007537208B2

(12) United States Patent
Fukusaka et al.

(10) Patent No.: US 7,537,208 B2
(45) Date of Patent: May 26, 2009

(54) SHEET FEEDING APPARATUS AND IMAGE FORMING APPARATUS

(75) Inventors: Tetsuro Fukusaka, Abiko (JP); Yuzo Matsumoto, Abiko (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/763,345

(22) Filed: Jun. 14, 2007

(65) Prior Publication Data

US 2007/0296136 A1 Dec. 27, 2007

(30) Foreign Application Priority Data

Jun. 21, 2006 (JP) ..... 2006-171510

(51) Int. Cl.
*B65H 3/12* (2006.01)

(52) U.S. Cl. ..... 271/96; 271/94

(58) Field of Classification Search ..... 271/108, 271/94, 96, 276

See application file for complete search history.

(56) References Cited

U.S. PATENT DOCUMENTS 4,291,974 A * 9/1981 Silverberg ..... 355/76
4,589,652 A * 5/1986 Silverberg ..... 271/245
4,632,381 A * 12/1986 Cuir et al. ..... 271/270
5,133,543 A * 7/1992 Eitel et al. ..... 271/276
5,645,274 A * 7/1997 Ubayashi et al. ..... 271/94
5,893,554 A * 4/1999 Okahashi et al. ..... 271/98
7,461,839 B2 * 12/2008 Ikeda ..... 271/108

FOREIGN PATENT DOCUMENTS

JP 06-278888 A 10/1994

* cited by examiner

*Primary Examiner*—Kaitlin S Joerger
(74) *Attorney, Agent, or Firm*—Canon USA Inc IP Div

(57) ABSTRACT

A sheet feeding apparatus includes a sheet feeding unit configured to suction a stored sheet with a negative pressure to feed the suctioned sheet, a suction duct connected to the sheet feeding unit, a suction fan configured to generate a negative pressure in the suction duct, a shutter disposed in the suction duct and configured to allow and shut off communication between the sheet feeding unit and the suction fan, and a communicating mechanism configured to cause a space in the suction duct between the shutter and the sheet feeding unit to communicate with an outside of the suction duct. The communicating mechanism is configured to cause the space in the suction duct to communicate with the outside of the suction duct according to the shutter shutting off communication between the sheet feeding unit and the suction fan.

10 Claims, 6 Drawing Sheets

SHEET FEEDING APPARATUS AND IMAGE FORMING APPARATUS

BACKGROUND OF THE INVENTION

1. Field of the Invention

The present invention relates to a sheet feeding apparatus configured to feed sheets one by one from a repository which stores a plurality of sheets, and to an image forming apparatus, such as a printer or a copying machine, having such a sheet feeding apparatus.

2. Description of the Related Art

A conventional sheet feeding apparatus in an image forming apparatus, such as a printer or a copying machine, is configured to separate sheets of paper such as a coated paper, which is difficult to separate, and to feed each sheet to an image forming unit. Such a sheet feeding apparatus employs an air sheet-feeding method. The air sheet-feeding type sheet feeding apparatus separates sheets by blowing air against an edge portion of a sheet stack stored in a repository to allow a sheet placed on the top of the sheet stack to float in the air. Then, the sheet feeding apparatus suctions the floated top-placed sheet with a negative pressure to the surface of a suction conveyance belt disposed above the sheet stack and conveys the sheet suctioned to the suction conveyance belt. This method is discussed in U.S. Pat. No. 5,645,274.

In the air sheet-feeding type sheet feeding apparatus, a suction duct is disposed on an inner side of an endless suction conveyance belt. A fan is provided to generate a negative pressure in the suction duct. Accordingly, a sheet is suctioned via a suction hole formed through the suction conveyance belt. The suction conveyance belt having the sheet suctioned thereto rotates to convey the sheet.

When such an air sheet-feeding type sheet feeding apparatus is used, it is necessary to appropriately adjust the level of negative pressure in the suction duct. In this regard, a shutter (or valve) is disposed between the fan and the suction duct to adjust the negative pressure in the suction duct by closing and opening the shutter.

The shutter is opened to reduce the internal pressure of the suction duct to a negative pressure in order to suction a sheet to the suction conveyance belt. When a sheet is suctioned and conveyed by the suction conveyance belt, the shutter is closed after a leading edge of the conveyed sheet has reached a conveyance roller disposed on a downstream side of the belt. Then, the rotation of the suction conveyance belt is stopped to prevent the next sheet from being suctioned and conveyed by the suction conveyance belt.

Japanese Patent Application Laid-Open No. 06-278888 discusses a sheet feeding apparatus including a shield belt having a portion in which a hole in communication with the suction duct is formed and a portion in which no holes are formed. The sheet feeding apparatus adjusts a negative pressure in the suction duct by rotating the shield belt integrally with the suction conveyance belt.

In the conventional sheet feeding apparatus discussed in Japanese Patent Application Laid-Open No. 06-278888, in separating sheets by blowing air against a sheet stack with a lower separation type sheet feeding apparatus, a sheet placed on the bottom of the sheet stack is suctioned to the suction conveyance belt in a state in which the holeless portion is externally directed so that the hole of the shield belt does not face the air. Subsequently, in conveying a sheet by rotating the suction conveyance belt, the shield belt is also rotated so that a surface on which the hole is formed is externally directed to cause the inside of the suction duct to communicate with the outside of the suction duct. That is, the internal negative pressure of the suction duct is controlled according to the rotation of the suction conveyance belt.

However, the conventional sheet feeding apparatus configured to adjust a negative pressure by opening and closing the shutter has the following problems.

Even when the leading edge of a sheet reaches a downstream side conveyance roller and thus a suction operation utilizing a negative pressure is stopped by closing the shutter, the suction hole formed in the suction conveyance belt is closed by the sheet which is being conveyed. Thus, the negative pressure remains in the suction duct. The sheet which is being conveyed is suctioned to the stopped suction conveyance belt. Accordingly, the conveyance roller disposed on the downstream side conveys the sheet suctioned to the suction conveyance belt. Accordingly, a large load is applied to a conveyance motor that drives the conveyance roller disposed on the downstream side. Thus, the conveyance roller cannot stably convey sheets. Accordingly, a skewed conveyance of sheets or jamming of sheets can occur. Furthermore, a sheet is pulled by both the suction conveyance belt and the conveyance roller. Thus, in the case of using a thin sheet whose stiffness is low, wrinkles can be caused on the sheet.

In the case of using a shield belt having a portion in which a hole for communicating with the suction duct is formed and a holeless portion, the shield belt and the suction conveyance belt are driven by the same drive roller. Thus, the apparatus alternately repeats maintaining of the negative pressure in the suction duct using the shield belt and releasing of the inside of the suction duct. Accordingly, the suction conveyance belt alternately repeats suctioning of the sheet utilizing the negative pressure and non-suctioning of the sheet due to absence of the negative pressure. Accordingly, the conveyance of sheets becomes unstable.

SUMMARY OF THE INVENTION

The present invention is directed to an image forming apparatus having a sheet feeding apparatus that employs an air sheet-feeding method.

According to an aspect of the present invention, a sheet feeding apparatus includes a sheet feeding unit configured to suction a stored sheet with a negative pressure to feed the suctioned sheet, a suction duct connected to the sheet feeding unit, a suction fan configured to generate a negative pressure in the suction duct, a shutter disposed in the suction duct and configured to allow and shut off communication between the sheet feeding unit and the suction fan, and a communicating mechanism configured to cause a space in the suction duct between the shutter and the sheet feeding unit to communicate with an outside of the suction duct according to the shutter shutting off communication between the sheet feeding unit and the suction fan.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the present invention will now herein be described in detail with reference to the drawings. It is to be noted that the relative arrangement of the components, the numerical expressions, and numerical values set forth in these embodiments are not intended to limit the scope of the present invention unless it is specifically stated otherwise.

Figure 6:
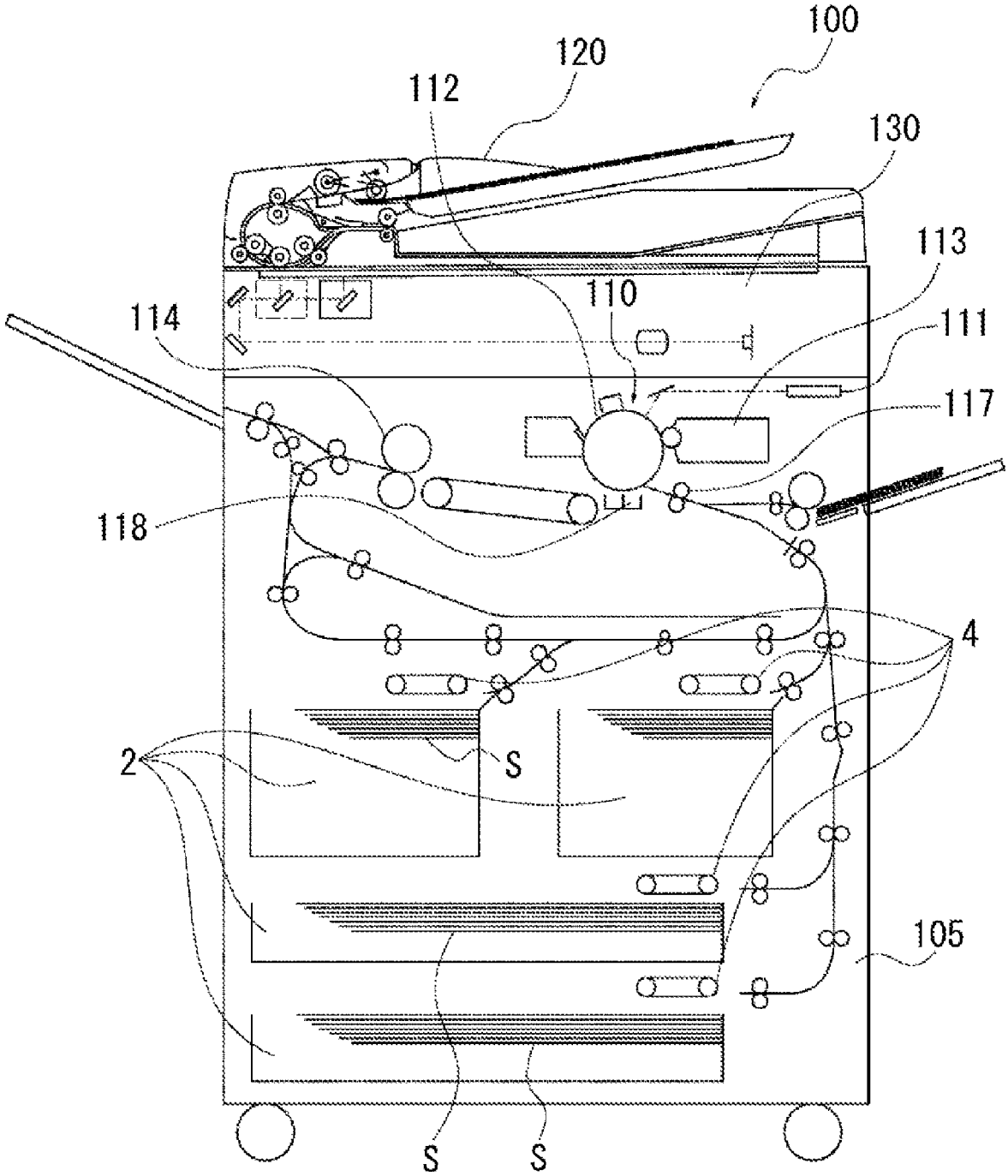
FIG. 6 illustrates a cross section of an image forming apparatus according to an exemplary embodiment of the present invention.

FIG. 6 illustrates a cross section of an image forming apparatus according to an exemplary embodiment of the present invention. Referring to FIG. 6, an image forming apparatus 100 includes an image forming apparatus body 105 having an image forming unit 110 configured to form an image on a sheet that is a recording paper, and an image reading unit 130 configured to read an image of an original. The image reading unit 130 includes an automatic document feeding unit 120 configured to convey an original document to a reading position, at which an image of the original document is automatically read.

Sheet repositories 2 for storing sheets S and a sheet feeding apparatus 4 having a suction conveyance belt used for feeding a sheet from the sheet repository 2 are disposed in a lower portion of the image forming apparatus body 105. The image forming unit 110 is disposed in an upper portion of the image forming apparatus body 105. The image forming unit 110 includes a photosensitive drum 112, a development device 113, a transfer unit 118, and a laser scanner unit 111. A registration roller pair 117 is disposed on an upstream side of the image forming unit 110 to correct skewing of a sheet and to adjust a timing at which a sheet is supplied to the image forming unit 110. A fixing roller pair 114 is disposed on a downstream side of the image forming unit 110 to fix a toner image.

The original document is automatically sent to the reading position by the automatic document feeding unit 120. Then, image information is read by the image reading unit 130. A controller (not shown) performs processing on the read image information. Subsequently, the laser scanner unit 111 outputs a laser beam according to a signal generated based on a result of the processing. Thus, an electrostatic latent image is formed on the surface of the photosensitive drum 112. The electrostatic latent image formed on the surface of the photosensitive drum 112 is developed by the development device 113.

Meanwhile, the sheet feeding apparatus 4 feeds a sheet, such as a recording paper and an overhead transparency (OHT) film, stored in the sheet repository 2 in synchronization with formation of a toner image on the photosensitive drum 112. Then, the toner image is transferred onto the sheet by the transfer unit 118. Subsequently, the sheet is guided to the fixing roller pair 114 and then applied with heat and pressure to fix the image on the sheet. Then, the sheet, on which the image has been fixed, is externally discharged.

Figure 1A:
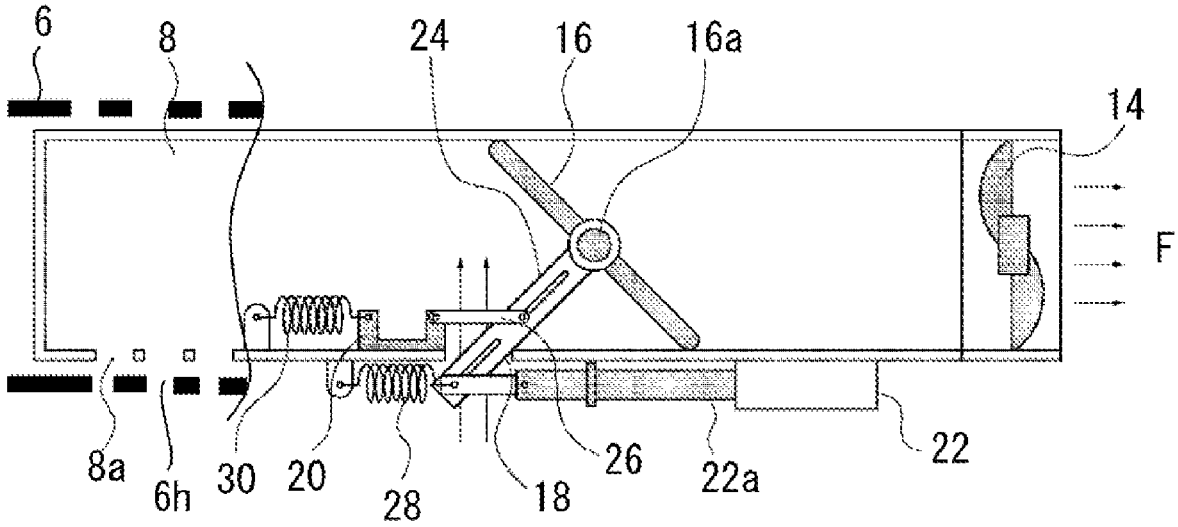
FIGS. 1A and 1B each illustrate a cross section of a negative pressure generating unit of a sheet feeding apparatus according to an exemplary embodiment of the present invention.
Figure 1B:
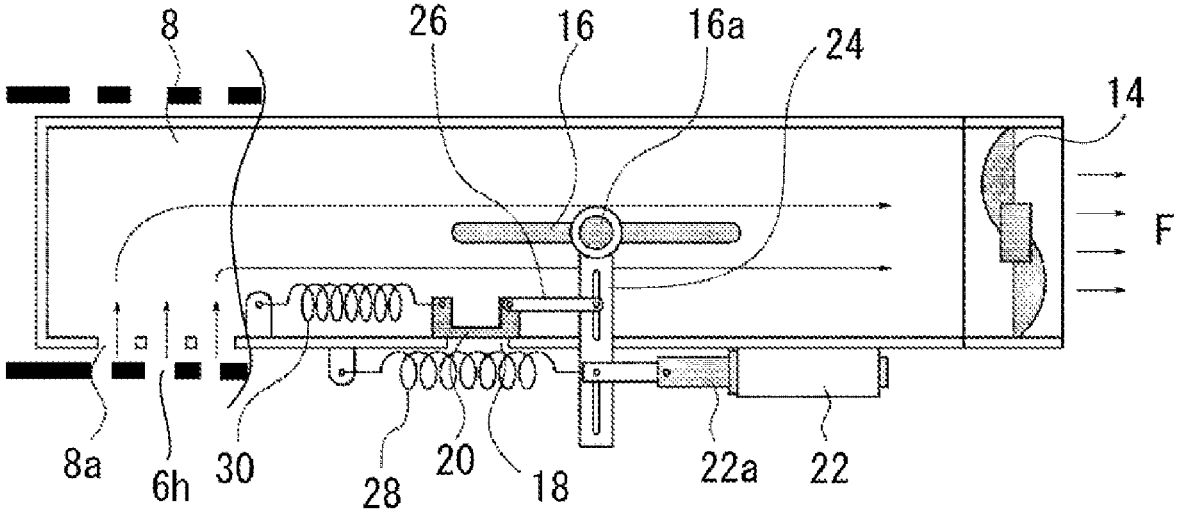
Figure 2:
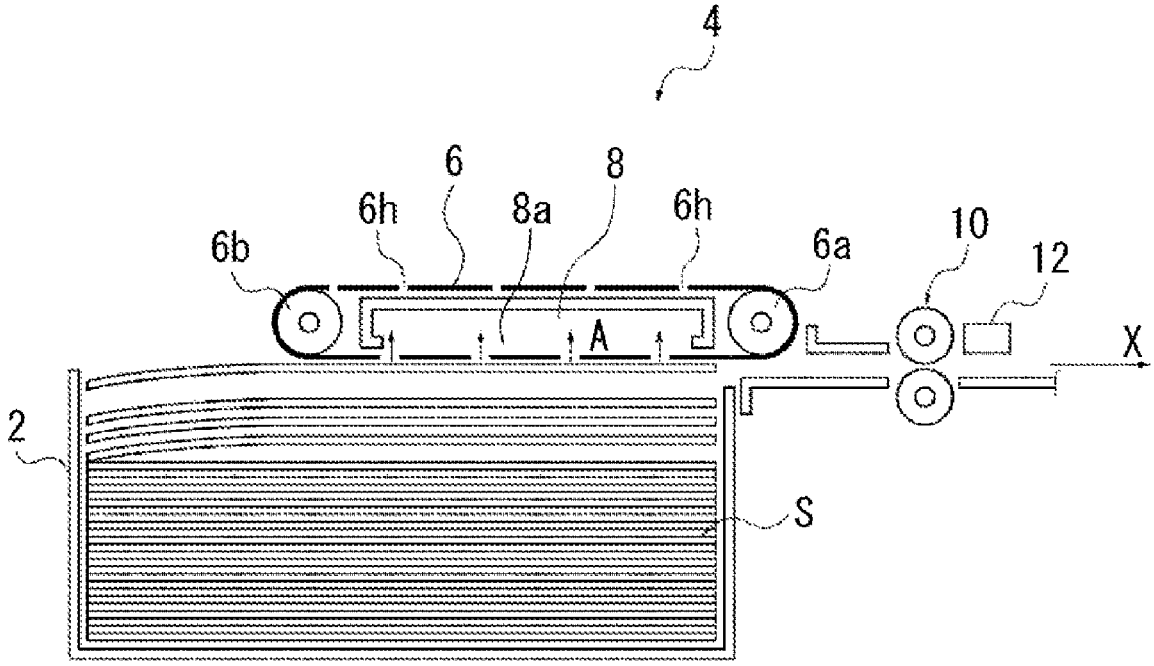
FIG. 2 illustrates a cross section of the sheet feeding apparatus according to an exemplary embodiment of the present invention.

FIGS. 1A and 1B each illustrate a cross section of a suction duct 8 of the sheet feeding apparatus 4 according to an exemplary embodiment of the present invention. FIG. 2 is a cross section of the sheet feeding apparatus 4 according to an exemplary embodiment of the present invention.

As illustrated in FIG. 2, the sheet feeding apparatus 4 includes the sheet repository 2 for storing sheets S and an endless suction conveyance belt 6 serving as a sheet feeding unit for suctioning the stored sheet with a negative pressure and feeding the suctioned sheet.

A plurality of suction holes **6*h* is formed through the suction conveyance belt 6, which is stretched between rollers 6*a* and 6*b* to be rotatable in a counterclockwise direction in FIG. 2. An end portion of the suction duct 8 is inserted from a lateral direction into an inner side of the suction conveyance belt 6. A suction opening 8*a* is formed in a lower portion of the end portion of the suction duct 8**.

With the above-described configuration, when a negative pressure is generated in the suction duct 8, a sheet is suctioned to the suction conveyance belt 6 by air coming through the suction opening **8*a* and the suction hole 6*h* of the suction conveyance belt 6. A suction fan 14 is disposed at an end portion of the suction duct 8 opposite to the end portion at which the suction opening 8*a* is disposed and is configured to generate a negative pressure in the suction duct 8. The suction fan 14 operates to discharge air in a direction F, as illustrated in FIG. 1B, thereby bringing the inside of the suction duct 8 into a negative pressure state. Furthermore, the suction duct 8 is provided with a suction completion sensor (not shown), which detects that a sheet is suctioned to the suction conveyance belt 6. A shutter 16, which can rotate around a shaft 16*a*, is provided between the suction opening 8*a* and the suction fan 14 to allow and shut off communication between the suction opening 8*a* and the suction fan 14**.

Now, a communicating mechanism configured to cause a space in the suction duct 8 between the shutter 16 and the suction opening **8*a* to communicate with the outside of the suction duct 8** will be described below.

An opening 18 is formed between the suction opening **8*a* and the shutter 16 in the suction duct 8 to cause the inside and the outside of the suction duct 8 to communicate with each other. Moreover, an opening/closing member 20 is provided in the suction duct 8 to be slidable along the inside wall of the suction duct 8 to cover and uncover the opening 18**.

Opening and closing operations of the shutter 16 and the opening/closing member 20 are controlled by a single solenoid 22. One end of a link member 24 is fixed to the shutter 16. A movable portion **22*a* of the solenoid 22 is connected to the other end of the link member 24. The solenoid 22 operates to rotate the link member 24 so that the shutter 16 rotates between a position at which the shutter 16 shuts off communication between the suction opening 8*a* and the suction fan 14 and another position at which the shutter 16 allows communication between the suction opening 8*a* and the suction fan 14. A position illustrated in FIG. 1A is a shutoff position at which the shutter 16 shuts off communication between the suction opening 8*a* and the suction fan 14. A position illustrated in FIG. 1B is a communicating position at which the shutter 16 allows communication between the suction opening 8*a* and the suction fan 14**.

The opening/closing member 20 is connected to a middle portion of the link member 24 via a support member 26. In addition, a spring 28 for rotating and urging the shutter 16 in a closing direction is attached to the link member 24. Furthermore, a spring 30 for urging the opening/closing member 20 in a direction to open the opening 18 is attached to the opening/closing member 20.

With the above-described configuration, when the shutter 16 is positioned in the communicating position, the negative pressure state inside the suction duct 8 can be maintained by the suction fan 14. When the shutter 16 is positioned in the shutoff position, a space between the shutter 16 and the suction opening 8*a* is cut off from a space between the suction fan 14 and the shutter 16. When the shutter 16 is rotated to the shutoff position, the opening 18 is opened by the opening/closing member 20. Thus, the space between the shutter 16 and the suction opening 8*a* in the suction duct 8 instantaneously communicates with the outside of the suction duct 8, so that the internal pressure of the suction duct 8 becomes an atmospheric pressure. Accordingly, the negative pressure for suctioning a sheet to the suction conveyance belt 6 is eliminated or reduced.

An air blowing unit (not shown) is provided in the sheet feeding apparatus 4 to suction only a top-placed sheet to the suction conveyance belt 6 by blowing air against a stack of sheets S stored in the sheet repository 2 and floating and separating several sheets placed in an upper portion of the sheet stack. The air blowing unit has a blowing nozzle, which is used to blow air against an edge portion of the sheets S, and a separation nozzle, which is used to blow air to suction only the top-placed sheet to the suction conveyance belt 6. The blowing nozzle and the separation nozzle are disposed on the lateral side of the sheet repository 2.

On a downstream side of the suction conveyance belt 6, a conveyance roller pair 10, serving as a conveyance member for extracting a sheet to convey the extracted sheet, and a sheet detection sensor 12, serving as a reflection type photosensor used to detect the conveyed sheet S, are disposed.

Figure 3:
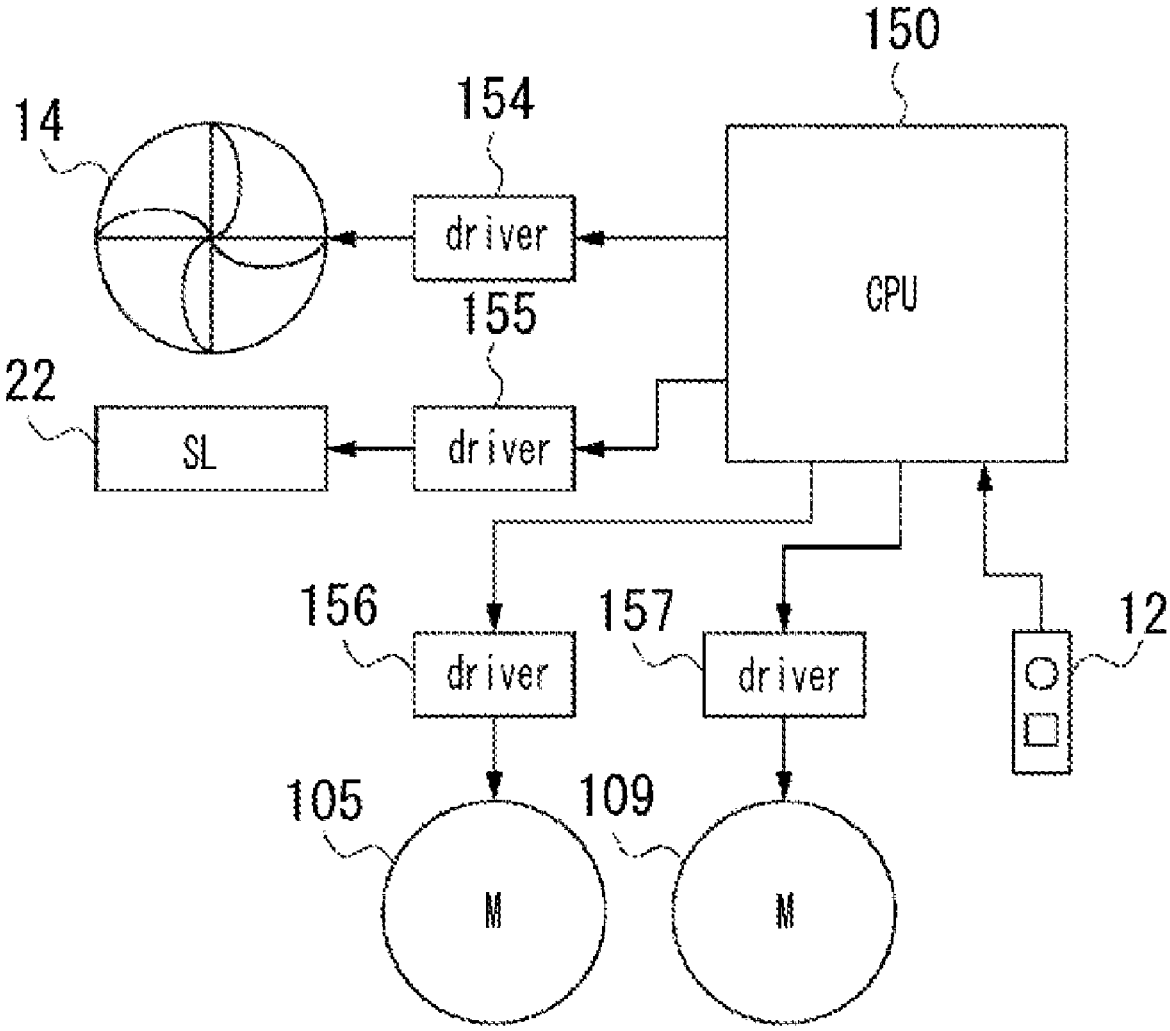
FIG. 3 illustrates an exemplary circuit block configuration of the sheet feeding apparatus according to an exemplary embodiment of the present invention.

FIG. 3 illustrates an exemplary circuit block configuration of the sheet feeding apparatus 4 according to an exemplary embodiment of the present invention. Referring to FIG. 3, a central processing unit (CPU) 150 is used to control the sheet feeding apparatus 4 and outputs a drive-start instruction to each of drive circuits of the sheet feeding apparatus 4. In addition, the CPU 150 receives output signals from the sheet detection sensor 12, which detects the conveyed sheet. A driver circuit 154 turns on and off the suction fan 14. A driver circuit 155 drives the solenoid 22 to move the shutter 16 and the opening/closing member 20, which is used to open and close the opening 18, in the suction duct 8. A driver integrated circuit (IC) 156 drives a belt drive motor 105 for driving the suction conveyance belt 6. A driver IC 157 drives a conveyance motor 109 for driving the conveyance roller pair 10.

Figure 4:
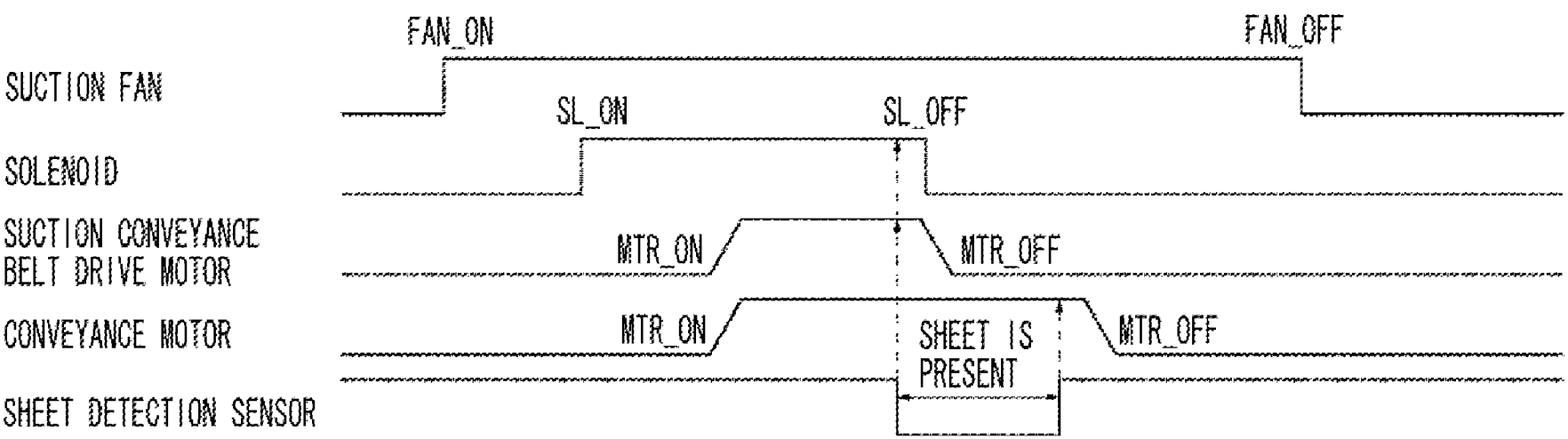
FIG. 4 is a timing chart illustrating an operation of the sheet feeding apparatus according to an exemplary embodiment of the present invention.

FIG. 4 is a timing chart illustrating an operation of the sheet feeding apparatus 4 according to an exemplary embodiment of the present invention. A sheet feeding operation performed by the sheet feeding apparatus 4 according to the exemplary embodiment will now be described below with reference to FIG. 4. Referring to FIG. 4, after the suction fan 14 is activated, the solenoid 22 is energized (turned on). Thus, the shutter 16 in the suction duct 8 is rotated to the communicating position. At the same time, the opening/closing member 20 closes the opening 18. Accordingly, a negative pressure is generated in the suction duct 8. Accordingly, the top-placed sheet S in the sheet repository 2 is suctioned to the suction conveyance belt 6 via the suction hole 6*h* formed through the suction conveyance belt 6.

After the suction completion sensor (not shown) detects that the top-placed sheet S is suctioned to the suction conveyance belt 6, the belt drive motor 105 is started to drive the suction conveyance belt 6. Furthermore, the conveyance motor 109 is started to drive the conveyance roller pair 10 placed on the downstream side. When the suction conveyance belt 6 is driven, the sheet S is sent to the conveyance roller pair 10 while being suctioned to the suction conveyance belt 6.

Then, the sheet detection sensor 12 detects that the sheet S sent to the conveyance roller pair 10 has reached the conveyance roller pair 10. After the sheet S has reached the conveyance roller pair 10, the solenoid 22 is de-energized (turned off) to rotate the shutter 16 in the suction duct 8 to the shutoff position. At the same time, the opening/closing member 20 opens the opening 18 to cause a space between the shutter 16 and the suction opening 8*a* in the suction duct 8 to instantaneously communicate with the outside of the suction duct 8. Then, the suction of the sheet S to the suction conveyance belt 6 is stopped. Thus, in a state in which the suction fan 14 is driven, the generation of a negative pressure in the suction duct 8 can be stopped with the shutter 16. In addition, a suctioning force for suctioning a sheet to the suction conveyance belt 6 can be eliminated or reduced by causing the inside of the suction duct 8 having been in the negative pressure state to communicate with the air through the opening 18.

Then, the suction conveyance belt 6 is stopped by stopping driving the belt drive motor 105. In this state, no suctioning force due to a negative pressure is generated. Accordingly, the sheet can be completely separated from the suction conveyance belt 6. Thus, a load applied to the conveyance motor 109 via the conveyance roller pair 10 is reduced. Thus, a sheet can be stably conveyed by the conveyance roller pair 10 without causing the skewing and jamming of sheets. In addition, the pulling of the sheet S by both the suction conveyance belt 6 and the conveyance roller pair 10 due to a difference in the rotation speed of the suction conveyance belt 6 and the conveyance roller pair 10 is not caused. Accordingly, in the case of using a thin sheet, wrinkles on the sheet can be prevented.

Subsequently, when the sheet detection sensor 12 detects that the sheet S has completely passed the conveyance roller pair 10, the conveyance roller pair 10 is stopped by stopping driving the conveyance motor 109.

Figure 5:
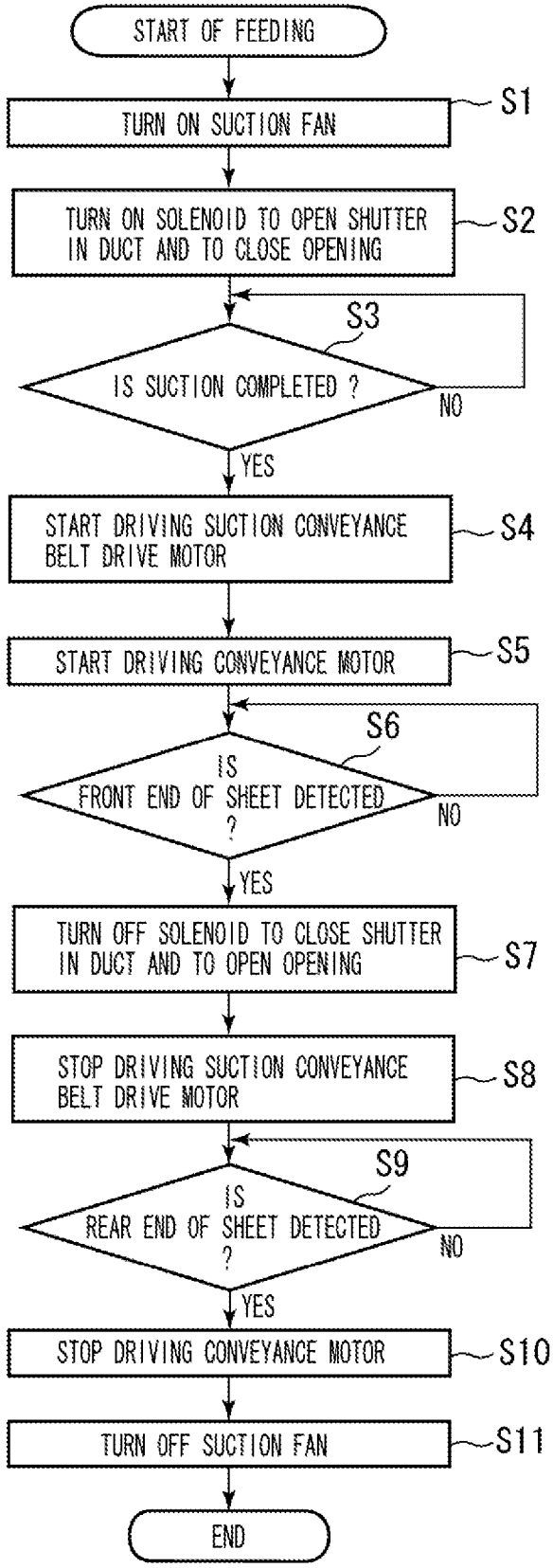
FIG. 5 is a flow chart illustrating an operation of the sheet feeding apparatus according to an exemplary embodiment of the present invention.

FIG. 5 is a flow chart illustrating an operation performed by the sheet feeding apparatus 4 according to an exemplary embodiment of the present invention. The flow chart of FIG. 5 briefly illustrates an example of an operation performed in a case where one sheet is fed. In an initial state, as illustrated in FIG. 1A, the shutter 16 is positioned at the shutoff position in the suction duct 8. The opening/closing member 20 is positioned at a position at which the opening 18 is opened. The level of the internal pressure of the suction duct 8 is equivalent to an atmospheric pressure. When a feed start signal is input to the CPU 150, in step S1, the CPU 150 activates the suction fan 14 (turn on the suction fan).

The air blowing unit (not shown) blows air against the sheets S stacked in the sheet repository 2. The sheet blown by air is floated. When a floated state of the sheet becomes stable, in step S2, the CPU 150 energizes (turns on) the solenoid 22. Accordingly, as illustrated in FIG. 1B, the shutter 16 in the suction duct 8 is moved to the communicating position. At the same time, the opening 18 is closed by the opening/closing member 20. Then, a negative pressure is generated in the suction duct 8 by the suction fan 14. In addition, a suctioning force acting in a direction A illustrated in FIG. 2 is generated via the suction opening 8*a* in the suction duct 8 and the suction hole 6*h* in the suction conveyance belt 6. Thus, an operation for suctioning the sheet to the suction conveyance belt 6 starts. Subsequently, in step S3, the CPU 150 continues monitoring an output signal from a suction completion sensor (not shown) disposed in the suction duct 8 until the sensor detects that the top-placed sheet S in the sheet repository 2 is suctioned.

When the suction completion sensor (not shown) detects the completion of the suction of the top-placed sheet S to the suction conveyance belt 6, in step S4, the CPU 150 starts driving the belt drive motor 105 to rotate the suction conveyance belt 6 having the sheet S suctioned thereto. Thus, the sheet S is conveyed from the repository 2. Subsequently, in step S5, the CPU 150 starts driving the conveyance motor 109 to rotate the conveyance roller pair 10 positioned at the downstream side. In step S6, the CPU 150 monitors an output from the sheet detection sensor 12 configured to determine whether the sheet S has reached the conveyance roller pair 10 until a leading edge (front end) of the sheet reaches the conveyance roller pair 10. If it is determined in step S6 that the leading edge of the sheet has reached the conveyance roller pair 10, then in step S7, the CPU 150 stops supplying power to the solenoid 22 (turns off the solenoid 22). Accordingly, as illustrated in FIG. 1A, the shutter 16 in the suction duct 8 is moved to the shutoff position to shut off communication between the suction fan 14 and the suction opening 8*a*. At the same time, the opening/closing member 20 is moved to open the opening 18. Thus, a space close to the suction opening 8*a* in the suction duct 8 divided by the shutter 16 communicates with the outside of the suction duct 8. Thus, the level of the pressure in the suction duct 8 is made equivalent to the atmospheric pressure and the suction of the sheet to the suction conveyance belt 6 is released.

In step S8, the CPU 150 stops driving the belt drive motor 105 to stop the rotation of the suction conveyance belt 6. As a result, the sheet S is completely separated from the suction conveyance belt 6. Thus, the pulling of the sheet S by both the suction conveyance belt 6 and the conveyance roller pair 10 due to a difference in the rotation speed of the suction conveyance belt 6 and the conveyance roller pair 10 is prevented. In step S9, the CPU 150 continues monitoring the position of a trailing edge (rear end) of the sheet S with the sheet detection sensor 12. If it is determined in step S9 that the trailing edge of the conveyed sheet S has been completely separated from the conveyance roller pair 10, then in step S10, the CPU 150 stops driving the conveyance motor 109 to stop the conveyance roller pair 10. In step S11, the CPU 150 stops the operation of the suction fan 14 to complete feeding of the sheet S.

The shutoff and communicating operations of the shutter 16 and the operations of opening and closing the opening 18 of the communicating mechanism by the opening/closing member 20 are performed using the single solenoid 22 in the present embodiment. However, the configuration is not limited to this, provided that opening or closing of the opening 18 is performed in synchronization with opening or closing of the shutter 16. That is, a different drive mechanism can be employed, provided that the apparatus satisfies such conditions that when the shutter 16 is positioned at the communicating position, the opening 18 is closed by the opening/closing member 20, and when the shutter 16 is positioned at the shutoff position, the opening 18 is opened.

While the present invention has been described with reference to exemplary embodiment, it is to be understood that the invention is not limited to the disclosed exemplary embodiment. The scope of the following claims is to be accorded the broadest interpretation so as to encompass all modifications, equivalent structures, and functions.

This application claims priority from Japanese Patent Application No. 2006-171510 filed Jun. 21, 2006, which is hereby incorporated by reference herein in its entirety.

What is claimed is:

1. A sheet feeding apparatus comprising:

a storage unit configured to store a plurality of sheets;

a sheet feeding unit configured to suction a sheet stored in the storage unit with a negative pressure and to feed the suctioned sheet;

a sheet conveyance unit disposed on a downstream side of the sheet feeding unit and configured to convey the sheet fed out from the sheet feeding unit;

a suction duct connected to the sheet feeding unit;

a suction fan configured to generate a negative pressure in the suction duct;

a shutter disposed in the suction duct and configured to allow and shut off communication between the sheet feeding unit and the suction fan; and a communicating mechanism configured to cause a space in the suction duct between the shutter and the sheet feeding unit to communicate with an outside of the suction duct;

wherein after a sheet fed out from the sheet feeding unit has reached the sheet conveyance unit, the shutter shuts off communication between the sheet feeding unit and the suction fan, the communicating mechanism communicates the space with the outside of the suction duct, and the sheet feeding unit stops a sheet feeding operation.

2. The sheet feeding apparatus according to claim 1, wherein the communicating mechanism includes an opening through which an inside and an outside of the suction duct provided between the sheet feeding unit and the shutter communicate with each other, and an opening/closing member configured to open and close the opening, and wherein the communicating mechanism causes the space in the suction duct to communicate with the outside of the suction duct with the opening being opened by the opening/closing member according to the shutter shutting off communication between the sheet feeding unit and the suction fan.

3. The sheet feeding apparatus according to claim 2, wherein an operation of the shutter for allowing and shutting off communication between the sheet feeding unit and the suction fan is performed in association with an operation of the opening/closing member for opening and closing the opening.

4. The sheet feeding apparatus according to claim 1, further comprising a solenoid, wherein the shutter is rotatably supported, wherein the opening/closing member is slidable along the opening, and wherein the solenoid facilitates a rotating operation of the shutter and a sliding operation of the opening/closing member.

5. The sheet feeding apparatus according to claim 1, wherein the sheet feeding unit is configured to suction a sheet to an endless suction conveyance belt with a negative pressure and to feed the sheet by rotation of the suction conveyance belt, wherein a suctioning opening of the suction duct is positioned inside the suction conveyance belt, and wherein the sheet is suctioned to the suction conveyance belt with a negative pressure generated in the suction duct by the suction fan.

6. An image forming apparatus comprising:

the sheet feeding apparatus according to claim 1; and an image forming unit configured to form an image on a sheet conveyed by the sheet conveyance unit.

7. The image forming apparatus according to claim 6, wherein the communicating mechanism includes an opening through which an inside and an outside of the suction duct provided between the sheet feeding unit and the shutter communicate with each other, and an opening/closing member configured to open and close the opening, and wherein the communicating mechanism causes the space in the suction duct to communicate with the outside of the suction duct with the opening being opened by the opening/closing member according to the shutter shutting off communication between the sheet feeding unit and the suction fan.

8. The image forming apparatus according to claim 7, wherein an operation of the shutter for allowing and shutting off communication between the sheet feeding unit and the suction fan is performed in association with an operation of the opening/closing member for opening and closing the opening.

9. The image forming apparatus according to claim 6, further comprising a solenoid, wherein the shutter is rotatably supported, wherein the opening/closing member is slidable along the opening, and wherein the solenoid facilitates a rotating operation of the shutter and a sliding operation of the opening/closing member.

10. The image forming apparatus according to claim 6, wherein the sheet feeding unit is configured to suction a sheet to an endless suction conveyance belt with a negative pressure and to feed the sheet by rotation of the suction conveyance belt, wherein a suctioning opening of the suction duct is positioned inside the suction conveyance belt, and wherein the sheet is suctioned to the suction conveyance belt with a negative pressure generated in the suction duct by the suction fan.

* * * * *